US012486979B2

(12) United States Patent
Olver et al.

(10) Patent No.: US 12,486,979 B2
(45) Date of Patent: Dec. 2, 2025

(54) FLARE TIPS

(71) Applicants: John W. Olver, Blacksburg, VA (US); Garabit Jack Sarkis, Beirut (LB); Emisshield Inc., Blacksburg, VA (US); Desert World Company, Khobar (SA)

(72) Inventors: John W. Olver, Blacksburg, VA (US); Garabit Jack Sarkis, Beirut (LB)

( * ) Notice: Subject to any disclaimer, the term of this patent is extended or adjusted under 35 U.S.C. 154(b) by 555 days.

(21) Appl. No.: 17/753,970

(22) PCT Filed: Sep. 18, 2020

(86) PCT No.: PCT/US2020/051586
§ 371 (c)(1),
(2) Date: Mar. 18, 2022

(87) PCT Pub. No.: WO2021/055813
PCT Pub. Date: Mar. 25, 2021

(65) Prior Publication Data

US 2022/0373177 A1 Nov. 24, 2022

Related U.S. Application Data

(60) Provisional application No. 62/902,384, filed on Sep. 18, 2019.

(51) Int. Cl.
*F23G 7/08* (2006.01)
*F23D 14/76* (2006.01)

(52) U.S. Cl.
CPC ..... *F23G 7/085* (2013.01); *F23D 14/76* (2013.01)

(58) Field of Classification Search
CPC ..... F23D 2900/00018; F23D 14/76
See application file for complete search history.

(56) References Cited

U.S. PATENT DOCUMENTS

| | | | | |
|---|---|---|---|---|
| 2,779,399 | A | 1/1957 | Zink et al. | |
| 3,306,338 | A | 2/1967 | Wright et al. | |
| 4,003,693 | A * | 1/1977 | Straitz, III | F23G 7/085 431/351 |
| 4,154,567 | A | 5/1979 | Dahmen | |
| 4,323,343 | A | 4/1982 | Reed et al. | |
| 4,682,568 | A | 7/1987 | Green et al. | |
| 5,668,072 | A * | 9/1997 | Holcombe, Jr. | F27D 1/16 106/14.44 |
| 5,724,923 | A | 3/1998 | Green | |
| 5,881,802 | A | 3/1999 | Green | |
| 6,136,117 | A | 10/2000 | Shibata et al. | |
| 6,152,087 | A | 11/2000 | Shibata et al. | |

(Continued)

FOREIGN PATENT DOCUMENTS

| | | |
|---|---|---|
| EP | 1397614 B1 | 3/2012 |
| GB | 2081872 A | 2/1982 |

*Primary Examiner* — Ko-Wei Lin
(74) *Attorney, Agent, or Firm* — Johnston Holroyd IP Law; Mary-Jacq. Holroyd

(57) ABSTRACT

A center flare tip assembly (16) and plenum flare tip assembly (18) with arms (20), having the outside of the center flare tip assembly (16), both inside and outside of the tips (18), the outside of the arms (20), and/or adjacent features of the flare tip (12) are covered with a high emissivity thermal layer (14) with an emissivity greater than 0.85. This reduces flare metal temperatures by thirty percent (30%) or greater, and increases flare life by two (2) to five (5) times current life.

19 Claims, 4 Drawing Sheets

(56) References Cited

U.S. PATENT DOCUMENTS

| | | | | |
|---|---|---|---|---|
| 7,066,242 | B1 | 6/2006 | Ranville et al. | |
| 7,105,047 | B2 * | 9/2006 | Simmons | C23C 24/08 106/801 |
| 7,247,016 | B2 | 7/2007 | Mashhour | |
| 7,354,265 | B2 | 4/2008 | Mashhour et al. | |
| 10,527,281 | B1 | 1/2020 | Brannon | |
| 2007/0238058 | A1 | 10/2007 | Zhu et al. | |
| 2013/0168470 | A1 * | 7/2013 | Olver | F23D 14/76 239/397.5 |
| 2015/0329402 | A1 * | 11/2015 | Afzal | C03B 23/0235 65/348 |
| 2016/0138805 | A1 | 5/2016 | Martin et al. | |
| 2016/0168034 | A1 | 6/2016 | Shah et al. | |

* cited by examiner

FLARE TIPS

RELATED APPLICATIONS

This application claims the benefit of U.S. Provisional Application Ser. No. 62/902,384 entitled "Flare Tips" filed on 18 Sep. 2019, the contents of which are incorporated herein by reference in its entirety.

COPYRIGHT NOTICE

A portion of the disclosure of this patent document may contain material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND OF THE INVENTION

Waste gasses from oil wells, natural gas wells, refineries, petroleum plants, chemical plants, steel industries, pharmaceuticals, pulp and paper plants, landfill facilities, food processing plants, on-/off-shore facilities, and the like are burned up using flares. The most common flares have flare stacks which culminate in flare tips, which are protected from wind by heat/wind shields. The flare stacks and tips may come in various sizes from small (a couple of inches) to large (120 inches). Some flares are ground flares, and do not have flare stacks, but instead have the flare tip horizontally disposed and extending from heat/wind shields.

High winds and rain may damage flare stacks and tips. Waste gas flare flames at the tip of the burner stacks are subject to being blown sideways, which can result in the failure of the stack/stack tips at the high heat zones. The surrounding area are potentially exposed to extreme temperatures that can cause environmental and structural damage. Extreme thermal oxidizing environments can also lead to tip, stack, and/or shield failure due to fatigue in metal components thereof.

A goal of flare technology is to create flares that are highly stable when exposed to windy and corrosive environments. Many alternative configurations have been used in addition to the typical wind shield including alternative configurations of windshields and flare tips such as versions with arms.

All of these efforts are designed to generate a high hydrocarbon destruction efficiency, which is measured as thermal destruction removal efficiency (DRE). It is also desirable to have little or no additional energy requirements to protect the high heat zones of the flare stack and tips.

Various efforts are used to cool the stacks and especially the flare tips to avoid failure of the flare tip or stack. These efforts include dynamic measures that require additional energy to maintain lower temperatures in the high heat zones. Dynamic measures include water, steam, or air cooling, which require energy to circulate and provide cooling.

Various configurations of flare tips and windshields are known. US Patent Application No. 2016/0138805 A1 teaches alternative flare tip and windshields including examples with arms. U.S. Pat. No. 4,323,343 shows a flare tip with alternative designs including arms and a windshield. UK Patent No. GB2081872A shows an alternative flare stack tip assembly. U.S. Pat. No. 4,154,567 shows an apparatus for the combustion of industrial waste gases which is disposed horizontally without the use of a stack.

U.S. Pat. No. 2,779,399 shows a flare stack which is used to burn off excessive quantities of combustible gas. U.S. Pat. No. 10,527,281 shows a gas flare stack with a windshield tube in which the windshield tube inner diameter is larger than the burner tube outer diameter. U.S. Pat. Nos. 7,247,016 and 7,354,265 teach flare tips and windshields for use on top of flare stacks to burn waste gases.

Efforts have also been made to use coatings with particular characteristics to protect the surfaces of the flare tips or components thereof. US Patent Application No. 20070238058A1 teaches the use of low emissivity coatings to achieve longer flare tip service life, improved flare tip structural integrity and/or more stable flame pattern under a wide range of operating conditions. Specifically, low emissivity coatings with an emissivity of less than about 0.80.

SUMMARY OF THE INVENTION

The present invention covers flare tips (12) having a high emissivity thermal protective/modification layer (14) with a center flare tip assembly (16) and at least one flare tip shield assembly (18). Arms (20) may be used to support the flare tip shield assembly (18) about the center flare tip assembly (16). The outside of the center flare tip assembly (16) is coated with a high emissivity thermal protective/modification layer (14). Both inside and outside of the flare tip shield assembly (18) are covered by the high emissivity thermal protective/modification layer (14), but only the outside of the arms (20) are covered with the high emissivity thermal protective/modification layer (14). Adjacent features of the flare tip (12) may also have a high emissivity thermal protective/modification layer (14) thereon.

The high emissivity thermal protective/modification layer (14) is two (2) mils to four (4) mils thick, and in a dry admixture contains from about 5% to about 30% of an inorganic adhesive, from about 45% to about 92% of a filler, and from about 1% to about 20% of one or more emissivity agents for metal surfaces. In the alternative, the layer (14) may contain from about 5% to about 35% colloidal silica, from about 23% to about 79% of a filler, and from about 2% to about 25% of one or more emissivity agents. Either may further contain from about 1% to about 5% of a stabilizer.

The hemispherical emissivity of the thermal protective layer is from about 0.85 to at least about 0.95 or higher. After optimization, the thermal oxidation efficiency is increased by up to 25%. Applied thickness of the high emissivity coating layer is 50 to 100 micrometers (2 through 4 mils), thermal stability is 3100° F., thermal shock resistance is −400° F. to 2750° F., and adhesion strength up to 5000 psi.

Nitrous oxides (NOx) and VOC emissions are reduced by up to 20%. The types of flare tips and windshields include visible-flame flares, including air-assisted, steam-assisted, and multi-point ground flares.

An advantageous aspect of the present invention is that it addresses the vulnerability that the flare tips (12) are prone to severe thermal oxidation, warping and fatigue due to the high temperatures. Most direct-fired thermal oxidizers operate at temperature levels between 980° C. and 1200° C. with air flow rates of 0.24 to 24 standard cm3/sec. The high emissivity layer (14) maximizes the thermal re-radiation characteristics of the heat zone and minimize flare metal temperatures. The delta temperature between the average thermal combustion chamber and the flare metal temperature increase significantly. Temperature of the coated flare metal structure can be reduced 200 to 400° C. or more.

Alternatively, another advantage of the present invention is that the thermal protective layer (14) limits thermal oxidation of metals by optimizing the thermal characteristics of the metal and minimizing the thermal environment of the heat generated by the flare. As a consequence, less maintenance is required, resulting in less downtime, increased flare life, and increasing the amount of continuous production possible with no shutdown.

A further advantage is that flare tips (12) having the high emissivity layer (14) have modified high heat zones in which the temperature is minimized by the emissivity agent(s) chosen.

These and other aspects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

FIG. 1 shows

FIGS. 6A-6C are yet another embodiment referred to as pit flares in which the flare tip (12) is horizontally disposed through a flare shield assembly, a horizontally disposed stack (S) may be visible or it may be disposed underground or the like.

Similar reference characters denote corresponding features consistently throughout the attached drawings.

DETAILED DESCRIPTION OF PREFERRED EMBODIMENTS

Figure 1A:
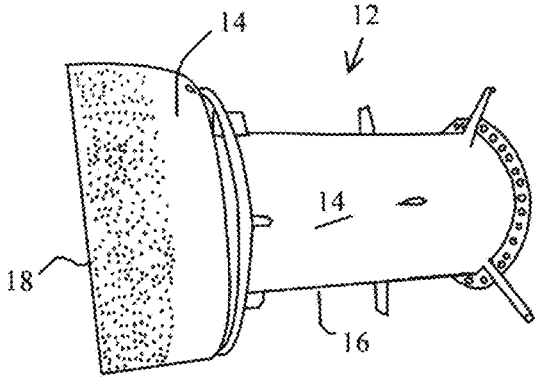
FIGS. 1A-1D show an embodiment of a flare tip (12) according to the present design.
Figure 1B:
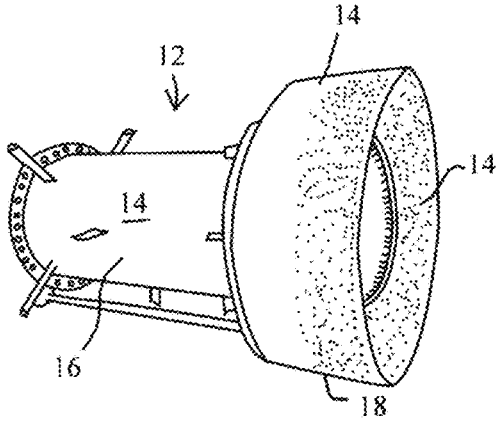
Figure 1C:
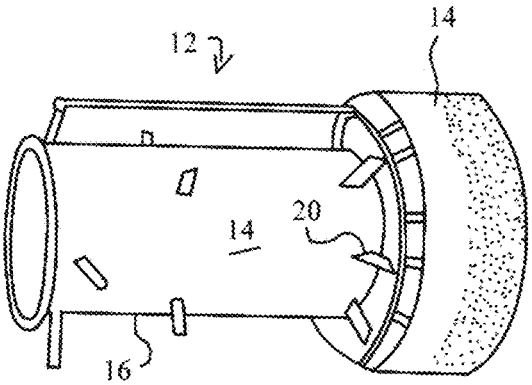
Figure 1D:
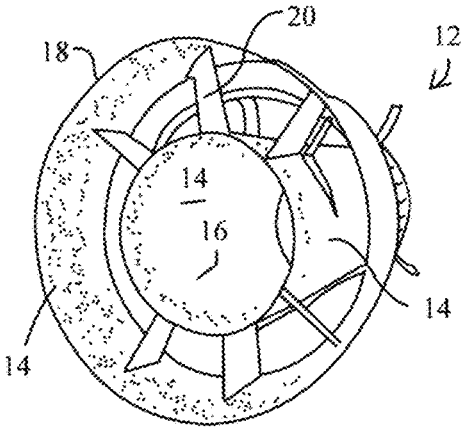
Figure 1E:
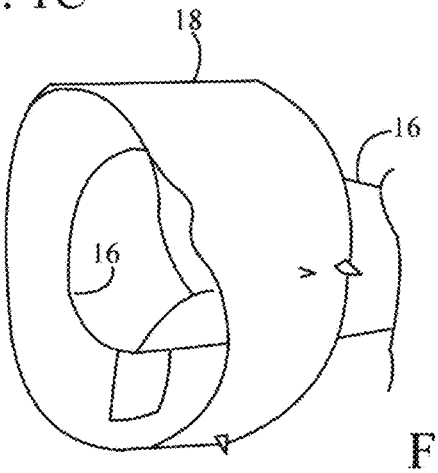
Prior Art FIG. 1E
FIG. 1E shows a prior art embodiment of a flare tip having the same form as FIGS. 1A-1D which has failed due to typical use. And thermal oxidation of the metal structure.

FIGS. 1A-1D show an embodiment of a flare tip (12) according to the present invention. The flare tips (12) have a high emissivity thermal layer (14), which has an emissivity greater than 0.85, with a center flare tip assembly (16) and flare tip shield assembly (18) with arms (20). The outside of the center flare tip assembly (16) was coated with a high emissivity thermal layer (14). Both inside and outside of the tips (18) are covered by the high emissivity thermal layer (14), but only the outside of the arms (20) are covered with the high emissivity thermal layer (14). Adjacent features of the flare tip (12) may also have a high emissivity thermal layer (14) thereon. FIG. 1E shows a prior art embodiment of a flare tip, having the same form as FIGS. 1A-1D, which has failed due to typical use.

Figure 2A:
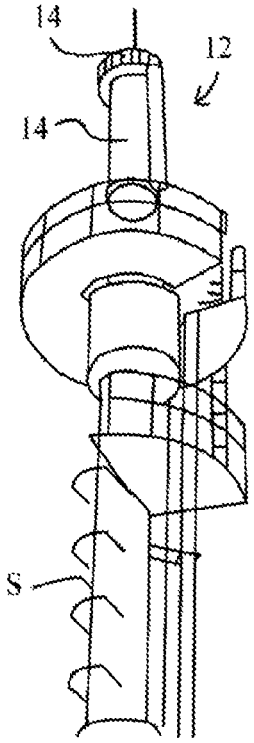
FIGS. 2A-2C show an alternative embodiment of a flare tip (12) according to the present design.
Figure 2B:
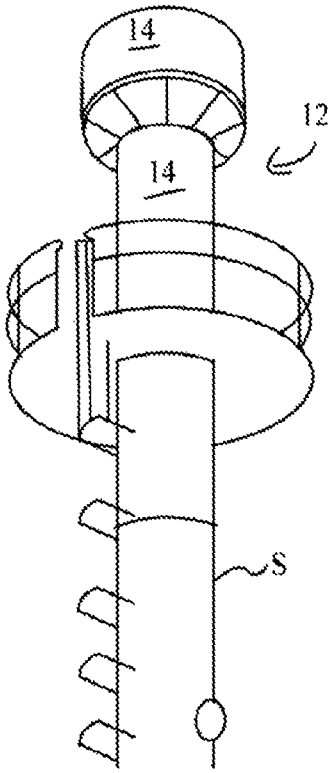
Figure 2C:
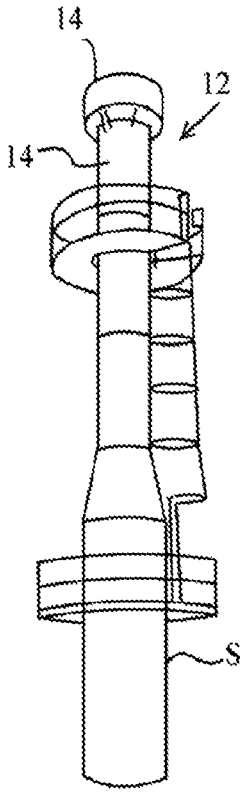

FIGS. 2A-2C show an alternative embodiment of the flare tip (12) being installed and in position on a stack (S). In operation, the tips (12) are disposed on top of, or at the end of, the flare stack (S) through which excess gasses escape and are burned off while the heat is radiated outward or upward towards the sky. The flare tip (12) serves to protect the stack (S) from failure due to exposure to flame that is being blown over. The high emissivity layer (14) provides an optimized thermal paradigm to reduce the temperature adjacent the high emissivity thermal layer (14) due to re-radiation of excessive heat of the flare tip (12) to maximize the gas burn off without generating excessive heat that destroys the stack (S) or the flare tip (12) should the wind blow the flame into contact with the flare tip (12) or stack (S). In addition to the high emissivity thermal layer (14) modifying the temperature paradigm, it also protects the metal of the flare tip (12) from thermal oxidation and failure.

Figure 3A:
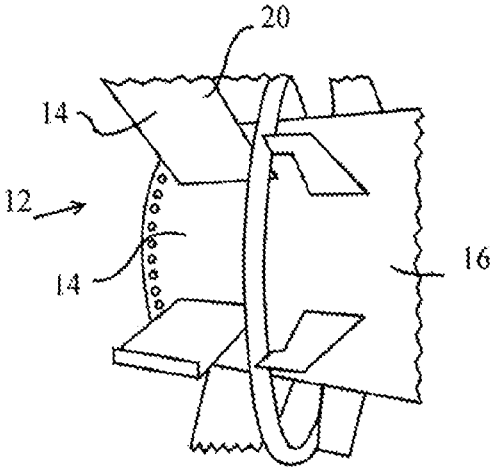
FIGS. 3A & 3B show an alternative embodiment of a flare tip (12) according to the present design.
Figure 3B:
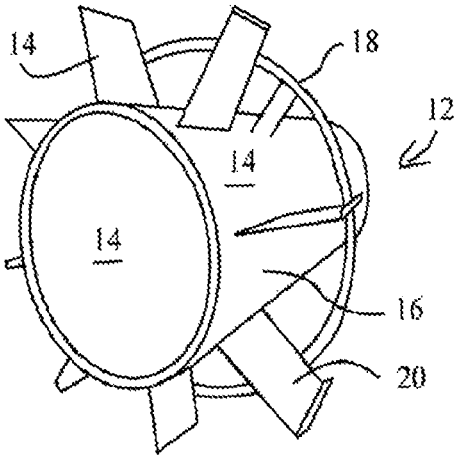

FIGS. 3A & 3B show an alternative embodiment of a flare tip (12) according to the present design. The arms (20) are of a different configuration. The part of the flare tip (12) shown in FIGS. 3A & 3B do not show the flare tip shield assembly (18) installed over the arms (20). The outside of both the center flare tip assembly (16) and the arms (20) have a high emissivity thermal layer (14) precoated during assembly or retrofitted thereafter.

Figure 4A:
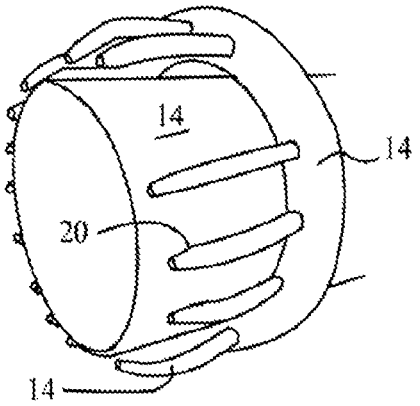
FIGS. 4A-4C show an alternative embodiment of a flare tip (12) according to the present design.
Figure 4B:
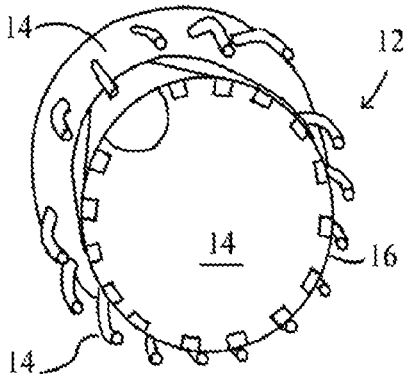
Figure 4C:
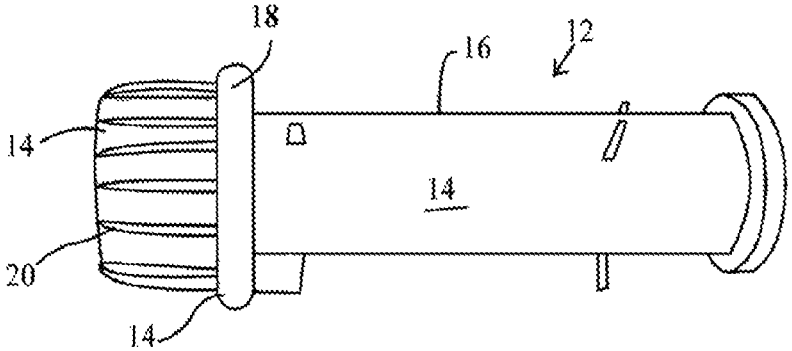

Similarly, FIGS. 4A-4C show an alternative embodiment of a flare tip (12) in which the plenum flare tip assembly (18) is not installed. The arms (20) in FIGS. 4A-4C are yet another configuration. The outside of both the center flare tip assembly (16) and the arms (20) have a high emissivity thermal layer (14) precoated during assembly.

Figure 5:
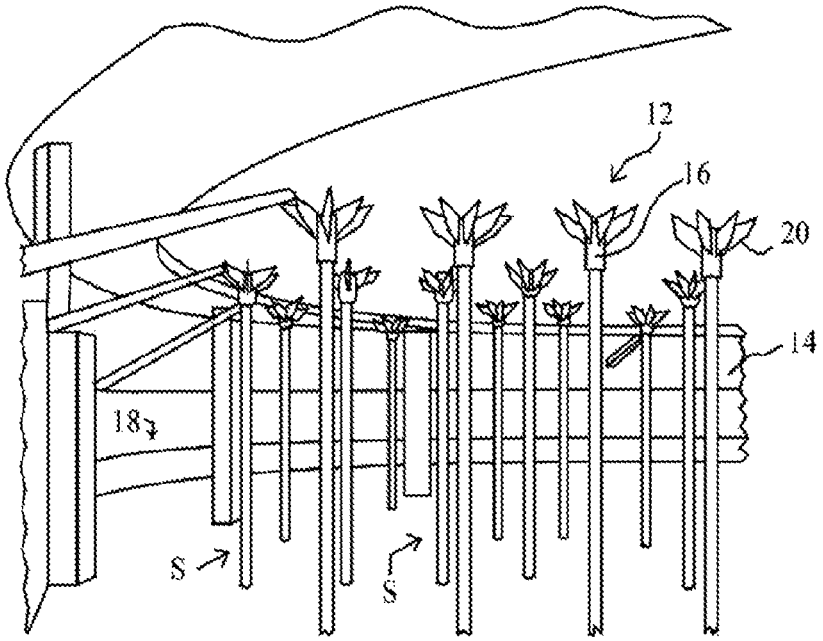
FIG. 5 shows yet another alternative embodiment of a flare tip (12) according to the present design in which multiple ground flares, stacks and tips, are disposed within a single much larger shield assembly which encompasses multiple flare tips (12) and flare stacks.

FIG. 5 shows yet another alternative embodiment of a flare tip (12) according to the present design in which multiple ground flares, stacks and tips, are disposed within a single much larger shield assembly (18) which encompasses multiple flare tips (12) and flare stacks (S). In this embodiment, the plurality of flare tips (12) with a high emissivity thermal layers (14) on outer surfaces of the center flare tip assemblies (16) and on both the inner and outer surfaces of the flare tip shield assembly (18) with arms (20) being coated, as well.

Figure 6A:
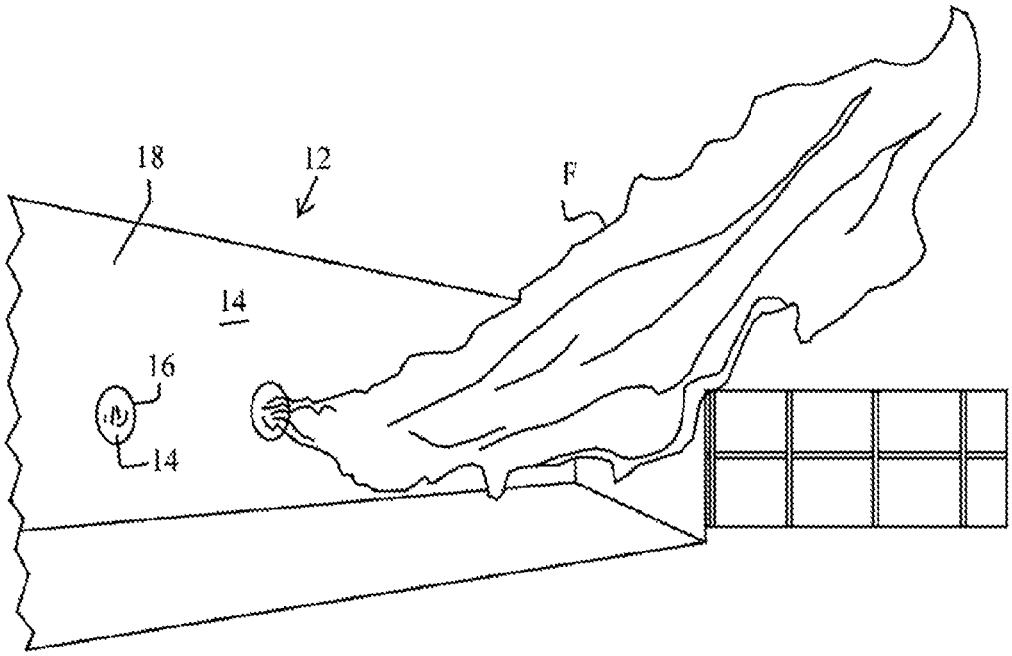
Figure 6B:
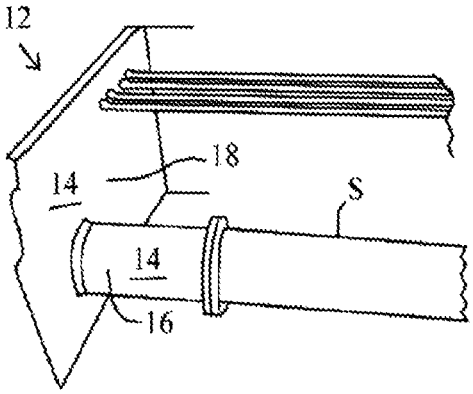
Figure 6C:
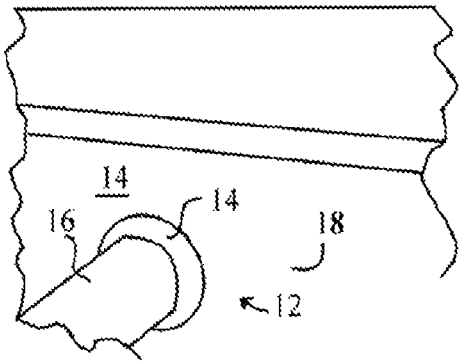

FIGS. 6A-6C are environmental views of yet another embodiment referred to as pit flares in which the flare tip (12) is horizontally disposed through a flare shield assembly (18), a horizontally disposed burner-stack (S) may be visible or it may be disposed underground or the like. As indicated in FIGS. 6A-6C, the high emissivity thermal layer (14) is disposed on both inner and outer surfaces of the flare tip shield assembly (18). In this embodiment, the flare tip (12) extends horizontally through the flare tip shield assembly (18). FIGS. 6B and 6C show the back side of two separate configurations of pit flare tip shield (18). Again, the outer surfaces of deployment mechanisms have a high emissivity layer (14) thereon, as shown. The outer surfaces of the flare tip assembly (16) has a high emissivity thermal layer (14) on both the outer part of the flare tip assembly (16) on the opposite side of the flare tip shield (18) from the flare's flame (F) and on the part of the flare tip assembly (16) that extends through the flare tip shield (18) where the flame exits the flare tip assembly (16) as shown in FIG. 6C. To modify the thermal temperature paradigm, and protect surfaces, all exposed metal and ceramic surfaces may be coated with the high emissivity thermal layer (14) but not all such surfaces need to be covered to be effective.

The protective/modification high emissivity thermal layer (14) is two (2) mils to four (4) mils thick, and in a dry admixture contains from about 5% to about 30% of an inorganic adhesive, from about 45% to about 92% of a filler, and from about 1% to about 20% of one or more emissivity agents for metal surfaces. In the alternative, the layer (14) may contain from about 5% to about 35% colloidal silica, from about 23% to about 79% of a filler, and from about 2% to about 20% of one or more emissivity agents for ceramic surfaces. Either may further contain from about 1% to about 5% of a stabilizer.

In a coating solution according to the present invention, a wet admixture of the thermal protective coating, to be applied to metal/alloy process tubes/assembly, contains from about 6% to about 40% of an inorganic adhesive, from about 23% to about 46% of a filler, from about 0.5% to about 10% of one or more emissivity agents, and from about 18% to about 50% water. In order to extend the shelf life of the coating solution, from about 0.5% to about 2.5% of a stabilizer is preferably added to the wet admixture. The wet admixture coating solution contains between about 40% and about 60% total solids.

The inorganic adhesive is preferably an alkali/alkaline earth metal silicate taken from the group consisting of sodium silicate, potassium silicate, calcium silicate, and magnesium silicate. The colloidal silica is preferably a mono-dispersed distribution of colloidal silica, and therefore, has a very narrow range of particle sizes. The filler is preferably a metal oxide taken from the group consisting of silicon dioxide, aluminum oxide, titanium dioxide, magnesium oxide, calcium oxide, titanium oxide and boron oxide. The emissivity agent(s) is preferably taken from the group consisting of silicon hexaboride, carbon tetraboride, silicon tetraboride, silicon carbide, molybdenum disilicide, tungsten disilicide, cerium oxide, zirconium diboride, cupric chromite, and metallic oxides such as iron oxides, magnesium oxides, manganese oxides, copper chromium oxides, and chromium oxides, cerium oxides, and terbium oxides, and derivatives thereof. The copper chromium oxide, as used in the present invention, is a mixture of cupric chromite and cupric oxide. The stabilizer may be taken from the group consisting of bentonite, kaolin, magnesium alumina silica clay, tabular alumina and stabilized zirconium oxide. The stabilizer is preferably bentonite. Other ball clay stabilizers may be substituted herein as a stabilizer. Colloidal alumina, in addition to or instead of colloidal silica, may also be included in the admixture of the present invention. When colloidal alumina and colloidal silica are mixed together one or the other requires surface modification to facilitate mixing, as is known in the art.

Coloring may be added to the high emissivity protective layer (14) of the present invention to depart coloring to the flares. Inorganic pigments may be added to the high emissivity coating without generating toxic fumes. In general, inorganic pigments are divided into the subclasses: colored (salts and oxides), blacks, white and metallic. Suitable inorganic pigments include but are not limited to yellow cadmium, orange cadmium, red cadmium, deep orange cadmium, orange cadmium lithopone and red cadmium lithopone. Additional pigments/colorants may be used.

A preferred embodiment of the present invention contains a dry admixture of from about 10% to about 25% sodium silicate, from about 50% to about 79% silicon dioxide powder, and from about 4% to about 15% of one or more emittance agent(s) taken from the group consisting of iron oxide, boron silicide, boron carbide, silicon tetraboride, cerium oxide, silicon carbide molybdenum disilicide, tungsten disilicide, zirconium diboride. Preferred embodiments of the high emissivity thermal coating may contain from about 1.0% to about 5.0% bentonite powder in dry admixture. The corresponding coating in solution (wet admixture) for this embodiment contains from about 10.0% to about 35.0% sodium silicate, from about 25.0% to about 50.0% silicon dioxide, from about 18.0% to about 39.0% water, and from about 1.0% to about 20% one or more emittance agent(s). In order to provide a coating solution admixture (wet admixture), which may be stored and used later, preferred embodiments of the thermal coating contain from about 0.25% to about 2.50% bentonite powder. Preferably deionized water is used. Preferred embodiments of the wet admixture have a total solids content ranging from about 45% to about 60%.

A preferred protective/modification high emissivity thermal coating of the present invention contains a dry admixture from about 15.0% to about 20.0% sodium silicate, from about 69.0% to about 79.0% silicon dioxide powder, about 1.00% bentonite powder, and from about 5.00% to about 15.0% of an emissivity agent(s). The emissivity agent is taken from one or more of the following: iron oxide, boron silicide, boron carbide, zirconium diboride, and cerium oxide.

A most preferred wet admixture contains about 20.0% sodium silicate based on a sodium silicate solids content of about 37.45%, from about 34.5% to about 39.5% silicon dioxide powder, about 0.500% bentonite powder, and from about 2.50% to about 20% of an emissivity agent, with the balance being water. The emissivity agent is most preferably taken from the group consisting of iron oxide, boron silicide, zirconium diboride, silicon carbide, and boron carbide (carbon tetraboride). Preferred embodiments include those where the emissivity agent comprises about 2.50% iron oxide, about 2.50% to about 7.5% boron silicide, or from about 2.50% to about 7.50% boron carbide. The pH of a most preferred wet admixture according to the present invention is about 11.2±1.0, the specific gravity is about 1.45±0.10 and the total solids content is about 50±1.0%.

Emissivity agents are available from several sources. Emissivity is the relative power of a surface to absorb and emit radiation, and the ratio of the radiant energy emitted by a surface to the radiant energy emitted by a blackbody at the same temperature. Emittance is the energy reradiated by the surface of a body per unit area. The high emissivity layer has an emissivity of 0.85 or greater.

Preferably the admixture of the present invention includes bentonite powder, tabular alumina, or magnesium alumina silica clay. The bentonite powder permits the present invention to be prepared and used at a later date. Preparations of the present invention without bentonite powder must be used immediately. The examples provided for the present invention include PolarGel bentonite powder, where technical grade bentonite is generally used for the purpose of suspending, emulsifying and binding agents, and as Theological modifiers. The pH value ranges from 9.5 to 10.5. Typical physical properties are 83.0 to 87.0 dry brightness, 2.50 to 2.60 specific gravity, 20.82 pounds/solid gallon, 0.0480 gallons for one pound bulk, 24 ml minimum swelling power, maximum 2 ml gel formation, and 100.00% thru 200 mesh.

Colorants, which may be added to the present invention, include but are not limited to inorganic pigments. Suitable inorganic pigments, such as yellow iron oxide, chromium oxide green, red iron oxide, black iron oxide, titanium dioxide, are available from Hoover Color Corporation. Additional suitable inorganic pigments, such as copper chromite black spinel, chromium green-black hematite, nickel antimony titanium yellow rutile, manganese antimony titanium buff rutile, and cobalt chromite blue-green spinel, are available from The Shepherd Color Company.

A surfactant may be added to the wet admixture prior to applying the thermal protective layer (14) to the support layer (14). The surfactant was surfyonol (trademark) 465 surfactant available from Air Products and Chemicals, Inc. The surfyonol (trademark) has a chemical structure of ethoxylated 2,4,7,9-tetramethyl 5 decyn-4,7-diol. Other surfactants may be used, such as STANDAPOL (trademark) T, INCI which has a chemical structure of triethanolamine lauryl sulfate, liquid mild primary surfactant available from Cognis-Care Chemicals. The amount of surfactant present by weight in the wet admixture in from about 0.05% to about 0.2%.

The present invention is applied to a substrate surface. The substrate surface may be a metallic substrate such as iron, aluminum, alloys, steel, cast iron, stainless steel and the like, as is well known in the art. The coating is typically applied wet, and either allowed to air dry or heat dry. The metal substrates may be internal or external surfaces of flares of all types that are subjected to high temperatures.

Surface preparation for metal flare systems are similar. The surface should be clear of all dirt, loose material, surfactants, oils, gasses, etc. A metal surface may be grit blasted. Grit blasting is desirable to remove oxidation and other contaminants Grits media should be sharp particles. Gun pressure will vary depending on the cut type, condition of the metal and profile desired. Very old metal will require 70-80 psi. Oil and water-free compressed air is required. Proper filters for the removal of oil and water are required.

After the grit blast, the surface should be thoroughly cleaned to remove all loose particles with clean oil and water free air blasts. Avoid contaminating surface with fingerprints. Acetone can be used (under proper ventilation and exercising all necessary precautions when working with acetone) on a clean cloth to wipe the surface clean. A cleaning compound may be used on certain stainless steel in lieu of grit blasting. Durlum 603 available from Blue Wave Ultrasonics, a powdered alkaline cleaner, may be used in cleaning metal surface.

When using the wet admixture containing a stabilizer, solids may settle during shipment or storage. Prior to use all coatings must be thoroughly re-mixed to ensure all settled solids and clumps are completely re-dispersed. When not using a stabilizer, the coating may not be stored for any period of time. In any case, the coating should be used immediately after mixing to minimize settling.

Mixing instructions for one and five gallon containers. High speed/high shear saw tooth dispersion blade 5" diameter for one gallon containers and 7" diameter for five gallon containers may be attached to a hand drill of sufficient power with a minimum no load speed of 2000 rpm shear. Dispersion blades can be purchased from numerous suppliers. Mix at high speed to ensure complete re-dispersion for a minimum of 30 minutes.

The product should be applied directly after cleaning a metal surface so minimal surface oxidation occurs. The product should be applied in a properly ventilated and well-lit area, or protective equipment should be used appropriate to the environment, for example within a firebox. The mixed product should not be filtered or diluted.

A high-volume low pressure (HVLP) spray gun should be used with 20-40 psi of clean, oil and water free air. Proper filters for removal of oil and water are required. Alternatively, an airless spray gun may be used. Other types of spray equipment may be suitable. The applicator should practice spraying on scrap metal prior to spraying the actual part to ensure proper coverage density. Suitable IVLP spray systems, which are desirable for metal/alloy process tubes, are available from G.H. Reed Inc. A high-speed agitator may be desirable. Suitable spray gun tips may be selected to provide the proper thickness without undue experimentation.

Controlling the coverage density of flare coatings may be critical to coating performance Dry coating thickness should be from about two (2) mils (about 50 microns (μ)) to about five (5) mils (about 125μ, depending upon typed, size and condition of substrate. One (1) mil equals 25.4μ. Proper thickness may vary depending upon flare type. Allow 1 to 4 hours of dry time before the flare is handled, depending upon humidity and temperature. Temperature reduction of the flare metal surface can be up to 30% with life expectancy increases of two (2) times to five (5) times depending upon flare type location and off gas composition.

The coating application has environmental application requirements for the coating. It takes from one (1) hour to four (4) hours for the coating to become dry to the touch. The maximum ambient temperature for the air for application of the coating to the surfaces of the flare tip (12) must be between 10° C. (50° F.) and 37° C. (100° F.). Provided, however, that the substrate temperature must be a minimum of 5° C. (41° F.) to 26° C. (80° F.) above the dew point temperature to avoid condensation before proceeding with the coating application. The coating material must be between 10° C. (50° F.) and 26° C. (80° F.), and must not be stored below 10° C. (50° F.). The maximum relative humidity is eighty percent (80%), while the preferred relative humidity is between forty percent (40%) and seventy-five percent (75%). The coating may be stored in a cool, dry, well-ventilated area at temperatures between 10° C. (50° F.) and 37° C. (100° F.). The lids on the containers must be kept sealed, and the shelf-life is a maximum of three (3) months in unopened containers.

The flare metal surface to be coated should be prepared for maximum efficiency. The substrate surfaces should be cleaned prior to being blasted. Visual inspection after cleaning the work. Abrasive blast for metal surface shall be followed. Blast profile should be no less than 1-2 mil and shall be measured with surface profile gauge and recorded. Any area with insufficient profile shall be re-blasted. All welds, if present, shall be preconditioned to a level C finish per the latest revision of NACE SPO178. Air blast metal surface to remove dust, clean surrounding area after blasting. Wipe clean metal surface with a lent free cloth using either acetone or Dirllum only after blasting.

Three examples were prepared and analyzed (FLM-1—forms black layer (14) when sintered, FLM-2, and FLM-6—forms gray layer (14)). Each coating composition is gray but may have different visible profile depending on constituents selected as emissivity agent(s). FLM-1 and FLM-6 may be sintered. FLM-1 turns black after sintering and FLM-6 turns gray/black after sintering. The blast profile is 1-2 mils, and the dry film thickness per pas is 1-2 mils with multiple passes with minimum dry film thickness being 2 mils to a maximum 4 mils. The operative temperature range for the flare tips (12) with high emissivity thermal protective/modification layer(s) (14) according to the present invention is ambient temperatures to about 1300° C. (2372° F.).

The desired thickness is two (2) to five (5) mils. Multiple passes may be necessary to achieve the desired thickness. Each layer (14) is allowed to fully dry before subsequent passes for best results. Each layer (14) should be of no less than one half (0.5) mil and no more than five (5) mils. Maximum coating thickness per layer (14) is 2 mils. A surface profile gauge may be used to measure the surface profile at specific intervals. If a test area fails to meet the requirement, the area should be blasted until it meets the requirement. There should be multiple repeated dry film thickness readings taken using an electronic thickness gauge. Five separate readings of the electronic thickness gauge should be sufficient. Again, if a test area fails to meet the requirement, the area should be blasted until it meets the requirement.

Testing equipment for flare operation includes a surface profile gauge, dry film thickness, tape testing, and cold emissivity meter. The surface profile gauge is available from DeFelsko, and model PosiTector to measure the blast profile (in mils/microns), which is used for metal or refractory substrates. Dry film thickness equipment is available from Check Line and Model 3000FX was used to measure the dry film thickness (in mils/microns), which is used for metal substrates. Tape testing equipment is available from Elcometer model 99 (ASTM 3359 Tape) to measure adhesion and the substrate is metal. Cold emissivity equipment is available from Surface Optics model #410 which measures solar absorptivity for metal, refractory, and fabric substrates. The equipment used in testing except for the surface optics, may be substituted with similar equipment. Safety equipment should be warn and safety practices followed with reference to comply with all OSHA, federal, state, local and facility safety plans, requirements, rules, regulations and laws. Density is an expression of total solids and is typically determined using a hydrometer or pycnometer It is to be understood that the present invention is not limited to the embodiments described above, but encompasses any and all embodiments within the scope of the following claims.

What is claimed is:

1. A flare tip (12) for optimizing a thermal paradigm to reduce temperature adjacent the flare tip (12), comprising:

a center flare tip assembly (16) having first inner and first outer surfaces, a plenum flare tip assembly (18) having second inner and second outer surfaces encompassing the center flare tip assembly (16), and arms (20) having at least an third outer surface and extending from the center flare tip assembly (16) to the plenum flare tip assembly (18), wherein the center flare tip assembly (16), the plenum flare tip assembly (18) and arms (20) are composed of metallic structures;

the inner surfaces defining an interior space extending from a first end to a second end allowing fluid gas communication therethrough;

the first outer surface of the center flare tip assembly (16) has a high emissivity thermal layer (14), both the second inner and second outer surfaces of the plenum flare tip assembly (18) are covered by a high emissivity thermal layer (14), the third outer surface of the arms (20) are covered with a high emissivity thermal layer (14), or any surface of the flare tip (12) have a high emissivity thermal layer (14) thereon, or combinations thereof;

a high emissivity thermal layer (14) disposed on either the first inner surface, or first outer surface, or second inner surface, or second outer surface, or third outer surface or combinations thereof; wherein the high emissivity thermal layer (14) contains from about 5% to about 30% of an inorganic adhesive, from about 45% to about 92% of a filler, and from about 1% to about 20% of one or more emissivity agents; or from about 5% to about 35% of colloidal silica, colloidal alumina, or combinations thereof; from about 23% to about 79% of a filler, from about 1% to about 25% of one or more emissivity agents.

2. The flare tip (12) of claim 1, wherein:

the high emissivity thermal layer (14) further comprises from about 1.0% to about 5.0% of a stabilizer;

the inorganic adhesive is taken from the group consisting of an alkali/alkaline earth metal silicate taken from the group consisting of sodium silicate, potassium silicate, calcium silicate, and magnesium silicate;

the filler is taken from the group consisting of silicon dioxide, aluminum oxide, titanium dioxide, magnesium oxide, calcium oxide, and boron oxide; or the one or more emissivity agents are taken from the group consisting of silicon hexaboride, boron carbide, silicon tetraboride, silicon carbide, molybdenum disilicide, tungsten disilicide, zirconium diboride, cupric chromite, cerium oxides, and metallic oxides; or combinations thereof.

3. The flare tip (12) of claim 2, wherein:

the stabilizer is taken from the group consisting of bentonite, kaolin, magnesium alumina silica clay, tabular alumina, and stabilized zirconium oxide.

4. The flare tip (12) of claim 1, wherein:

the thermal protective layer (14) contains from about 5% to about 35% of colloidal silica, colloidal alumina, or combinations thereof; and from about 23% to about 79% of a filler taken from the group consisting of silicon dioxide, aluminum oxide, titanium dioxide, magnesium oxide, calcium oxide, and boron oxide; and from about 1% to about 25% of one or more emissivity agents taken from the group consisting of silicon hexaboride, boron carbide, silicon tetraboride, silicon carbide, molybdenum disilicide, tungsten disilicide, zirconium diboride, cupric chromite, cerium oxide, and metallic oxides; or from about 5% to about 35% of colloidal silica, colloidal alumina, or combinations thereof; and from about 23% to about 79% of a filler taken from the group consisting of silicon dioxide, aluminum oxide, titanium dioxide, magnesium oxide, calcium oxide, and boron oxide; and from about 1% to about 25% of one or more emissivity agents taken from the group consisting of silicon hexaboride, boron carbide, silicon tetraboride, silicon carbide, molybdenum disilicide, tungsten disilicide, zirconium diboride, cupric chromite, cerium oxide, and metallic oxides; and from about 1.5% to about 5.0% of a stabilizer taken from the group consisting of bentonite, kaolin, magnesium alumina silica clay, tabular alumina, and stabilized zirconium oxide; or combinations thereof.

5. The flare tip (12) of claim 1, wherein:

at least one of the high emissivity thermal layers (14) disposed on the flare tip (12) surfaces including the first inner surface, or first outer surface, or second inner surface, or second outer surface, or third outer surface contains from about 5% to about 30% of an inorganic adhesive, the inorganic adhesive is taken from the group consisting of an alkali/alkaline earth metal silicate taken from the group consisting of sodium silicate, potassium silicate, calcium silicate, and magnesium silicate; from about 45% to about 92% of a filler, the filler taken from the group consisting of silicon dioxide, aluminum oxide, titanium dioxide, magnesium oxide, calcium oxide, and boron oxide; and from about 1% to about 25% of one or more emissivity agents taken from the group consisting of silicon hexaboride, boron carbide, silicon tetraboride, silicon carbide, molybdenum disilicide, tungsten disilicide, zirconium diboride, cupric chromite, cerium oxide, and metallic oxides; or from about 5% to about 30% of an inorganic adhesive, the inorganic adhesive is taken from the group consisting of an alkali/alkaline earth metal silicate taken from the group consisting of sodium silicate, potassium silicate, calcium silicate, and magnesium silicate; from about 45% to about 92% of a filler, the filler taken from the group consisting of silicon dioxide, aluminum oxide, titanium dioxide, magnesium oxide, calcium oxide, and boron oxide; and from about 1% to about 25% of one or more emissivity agents taken from the group consisting of silicon hexaboride, boron carbide, silicon tetraboride, silicon carbide, molybdenum disilicide, tungsten disilicide, zirconium diboride, cupric chromite, and metallic oxides; and from about 1% to about 5% of a stabilizer taken from the group consisting of bentonite, kaolin, magnesium alumina silica clay, tabular alumina, and stabilized zirconium oxide.

6. The flare tip (12) of claim 1, wherein:

at least one of the high emissivity thermal layers (14) disposed on the flare tip (12) surfaces including the first inner surface, or first outer surface, or second inner surface, or second outer surface, or third outer surface contains from about 10% to about 30% sodium silicate, from about 50% to about 79% silicon dioxide powder, and from about 4% to about 20% of one or more emissivity agents taken from the group consisting of iron oxide, boron silicide, boron carbide, silicon tetraboride, silicon carbide powder, cerium oxides, molybdenum disilicide, tungsten disilicide, and zirconium diboride; or from about 10% to about 30% sodium silicate, from about 50% to about 79% silicon dioxide powder, from about 4% to about 20% of one or more emissivity agents taken from the group consisting of iron oxide, boron silicide, boron carbide, silicon tetraboride, silicon carbide powder, molybdenum disilicide, tungsten disilicide, cerium oxide, and zirconium diboride, and from about 1% to about 5% of a stabilizer taken from the group consisting of bentonite, kaolin, magnesium alumina silica clay, tabular alumina, and stabilized zirconium oxide.

7. The flare tip (12) of claim 1, wherein:

the high emissivity thermal layer (14) contains from about 5% to about 30% of an inorganic adhesive, the inorganic adhesive is taken from the group consisting of an alkali/alkaline earth metal silicate taken from the group consisting of sodium silicate, potassium silicate, calcium silicate, and magnesium silicate; from about 45% to about 92% of a filler, the filler taken from the group consisting of silicon dioxide, aluminum oxide, titanium dioxide, magnesium oxide, calcium oxide, and boron oxide; and from about 1% to about 25% of one or more emissivity agents taken from the group consisting of silicon hexaboride, boron carbide, silicon tetraboride, silicon carbide, molybdenum disilicide, tungsten disilicide, zirconium diboride, cupric chromite, cerium oxide, and metallic oxides; or from about 5% to about 30% of an inorganic adhesive, the inorganic adhesive is taken from the group consisting of an alkali/alkaline earth metal silicate taken from the group consisting of sodium silicate, potassium silicate, calcium silicate, and magnesium silicate; from about 45% to about 92% of a filler, the filler taken from the group consisting of silicon dioxide, aluminum oxide, titanium dioxide, magnesium oxide, calcium oxide, and boron oxide; and from about 1% to about 25% of one or more emissivity agents taken from the group consisting of silicon hexaboride, boron carbide, silicon tetraboride, silicon carbide, molybdenum disilicide, tungsten disilicide, zirconium diboride, cupric chromite, cerium oxide, and metallic oxides; and from about 1% to about 5% of a stabilizer taken from the group consisting of bentonite, kaolin, magnesium alumina silica clay, tabular alumina, and stabilized zirconium oxide.

8. The flare tip (12) of claim 1, wherein:

the high emissivity thermal layer (14) contains from about 10% to about 30% sodium silicate, from about 50% to about 79% silicon dioxide powder, and from about 4% to about 20% of one or more emissivity agents taken from the group consisting of iron oxide, boron silicide, boron carbide, silicon tetraboride, silicon carbide powder, molybdenum disilicide, tungsten disilicide, cerium oxide, and zirconium diboride; or from about 10% to about 30% sodium silicate, from about 50% to about 79% silicon dioxide powder, from about 4% to about 20% of one or more emissivity agents taken from the group consisting of iron oxide, boron silicide, boron carbide, silicon tetraboride, silicon carbide powder, molybdenum disilicide, tungsten disilicide, cerium oxide, and zirconium diboride, and from about 1% to about 5% of a stabilizer taken from the group consisting of bentonite, kaolin, magnesium alumina silica clay, tabular alumina, and stabilized zirconium oxide.

9. The flare tip (12) of claim 1, wherein:

the high emissivity thermal layer (14) is disposed on the first outer surface of the center flare tip assembly (16).

10. The flare tip (12) of claim 1, wherein:

the high emissivity thermal layer (14) is disposed on the outer surface of the arms (20).

11. The flare tip (12) of claim 1, wherein:

the high emissivity thermal layer (14) is disposed on the second inner surface.

12. The flare tip (12) of claim 1, wherein:

the high emissivity thermal layer (14) is disposed on the second outer surface.

13. The flare tip (12) of claim 1, wherein:

the high emissivity thermal layer (14) is disposed on the second outer surface and on the second inner surface.

14. The flare tip (12) of claim 1, wherein:

the high emissivity thermal layer (14) is disposed on the second outer and on the second inner surfaces, and the high emissivity thermal protective/modification layer (14) is disposed on the third outer surface.

15. The flare tip (12) of claim 1, wherein:

the high emissivity thermal layer (14) is disposed on the first outer surface;

the high emissivity thermal layer (14) is disposed on the third outer surface; and the high emissivity thermal layer (14) is disposed on the first outer and on the first inner surfaces.

16. The flare tip (12) of claim 1, wherein:

the temperature is reduced by 30%.

17. The flare tip (12) of claim 1, wherein:

the life of the flare tip (12) and the center flare tip assembly (16), the plenum flare tip assembly (18), and arms (20) is increased by two to five times that of noncoated products.

18. The flare tip (12) of claim 1, wherein:

the high emissivity thermal layer has an emissivity of about 0.85 or greater.

19. The flare tip (12) of claim 2, wherein:

the high emissivity thermal layer has an emissivity of about 0.85 or greater.

* * * * *